US006645097B2

(12) United States Patent
Samuel et al.

(10) Patent No.: US 6,645,097 B2
(45) Date of Patent: Nov. 11, 2003

(54) BUMPER TOY PUCK FOR USE IN GAMES AND MARKETING

(75) Inventors: Anthony Samuel, New York, NY (US); Florence Poret, Kaufbeuren (DE)

(73) Assignee: Demo L.L.C., Los Angeles, CA (US)

( * ) Notice: Subject to any disclaimer, the term of this patent is extended or adjusted under 35 U.S.C. 154(b) by 0 days.

(21) Appl. No.: 10/032,350

(22) Filed: Dec. 21, 2001

(65) Prior Publication Data

US 2003/0119613 A1 Jun. 26, 2003

(51) Int. Cl.[7] ..... A63B 71/00
(52) U.S. Cl. ..... 473/588
(58) Field of Search ..... 473/588, 589

(56) References Cited

U.S. PATENT DOCUMENTS

| | | | | |
|---|---|---|---|---|
| 2,454,492 A | | 11/1948 | Turnbull | |
| 2,467,043 A | | 4/1949 | Kotler | |
| 2,494,929 A | | 1/1950 | Colaluca | |
| 3,610,625 A | * | 10/1971 | Erno et al. | 473/588 |
| 4,183,536 A | * | 1/1980 | Platt | 473/588 |
| 4,248,010 A | * | 2/1981 | Fox | 273/126 R |
| 5,014,990 A | | 5/1991 | Kaser et al. | |
| 5,275,410 A | * | 1/1994 | Bellehumeur et al. | 473/570 |
| 5,722,906 A | | 3/1998 | Gentile | |
| 5,816,964 A | * | 10/1998 | Ainslie et al. | 446/47 |
| 5,984,753 A | * | 11/1999 | Perez | 473/588 |
| 6,126,561 A | | 10/2000 | Mark | |

OTHER PUBLICATIONS

Brief description of "Footpucks. Tolle Spiele fur draussen und drinnen," by Nico Rohrbach: 1999, from a printout of an http://www.amazon.de page; an automatic English translation thereof (from http://world.altavista.com); and an enlarged picture of the Rohrbach game.

* cited by examiner

*Primary Examiner*—Raleigh W. Chiu
(74) *Attorney, Agent, or Firm*—Morgan & Finnegan, L.L.P.

(57) ABSTRACT

A disk-shaped kicking toy for use as an alternative to a soccer ball, shuffleboard pucks or weights, a hockey puck or ball, or in a game of the player's own creation. The kicking toy is intended to be constructed of a material that slides well on many surfaces and be surrounded by a ring of highly elastic rubber to increase its rebounding properties. The center of the kicking toy is preferably constructed of a transparent material under which indicia or marketing material may be displayed for marketing, distinguishing or commemorative purposes. Alternatively, the center section may house any of a number of devices including sensors, cameras, transmitters, sound devices or lighting apparatus to highlight the marketing material.

20 Claims, 15 Drawing Sheets

BUMPER TOY PUCK FOR USE IN GAMES AND MARKETING

TECHNICAL FIELD

The following apparatus relates to the field of toys and games, and more particularly to a bumper toy puck that can be used in different kinds of games and/or be used as a marketing tool.

BACKGROUND

Sporting events and games, in general, can be played using any of a number of objects. For example, some objects used in sporting events include flying disks, balls, pucks or other such objects. With a kicking game such as soccer, for example, the participant usually elects to use a ball. If the game to be played is hockey, then a puck or ball is often used, depending on the playing field.

The use of a ball in a sporting event can be limiting. When kicked, a ball can travel upward through the air, which might not be desirable. The use of a hockey puck is also severely limited by the playing surface on which the participant chooses to play. A flat and smooth surface is an example of a playing field where the use of a standard, sliding, flat-bottomed puck is practical. However, if the playing surface is rough, as often experienced in street hockey, the use of such a flat-bottom puck is highly impractical.

A standard hockey puck used on an ice surface has the geometry of a short cylinder, about one inch thick and about three inches in diameter, and is often made of a hard rubber. When used on ice, the puck has tendency to slide on one of the disk faces, even when the puck starts out rolling on its side.

Hockey is also played on hard, non-ice surfaces, such as streets and roadways. When a conventional hockey puck is used on hard surfaces as such, the friction of the surface (greater than that of ice) tends to allow a rolling puck to remain rolling. Further, the friction of such hard surfaces is typically so great that a puck will not slide very far on one of the disk faces, generally not sufficiently far enough to be used in a hockey game, and never as far as would be expected playing on ice. Additionally, a conventional hockey puck has a tendency to bounce when used on such hard surfaces. Conventional hockey balls, which are typically plastic spheroids, are too light in weight and too soft to provide the desired feel and action akin to ice hockey.

Despite the disadvantages of many traditional pieces of sports equipment, such objects have been used as marketing tools. The desire to combine sporting events with marketing activities has long been sought after by various groups including advertisers, corporations, sponsors, sport enthusiasts and the like. Often times, this combination has lead to less than satisfactory results. Sporting events such as the great American past time of baseball have often included marketing themes. Such themes have utilized the printing of logos or labels on give-away baseball shirts, hats or gloves. However, such product use has produced limited success.

One of the disadvantages of using such give-away products for marketing purposes is that the give-away products are game specific. Once the recipients of these giveaway products turns to participate in another sporting event or game, the give-away object is no longer used. In the example of baseball give-away products, the recipients cannot use such a product if the recipients later decide to play soccer or hockey. The give-away products are game specific and will not be used in the next game. Another disadvantage of these give-away products is that the recipients often do not take notice to the logos or labels on the products. For the sports enthusiast, when a game is being played, logos or labels are often ignored. Often times, the logo, or label is not even visible during the play of the sporting event or game.

Accordingly, there is a need for a toy game puck that can be used successfully on different kinds of surfaces including rough surfaces such as roadways, sidewalks, concrete or carpet, and smooth surfaces such as ice or wood. There is a need for the toy game puck to have the feel and action similar to that of conventional game objects. Additionally, there is a need for a toy game puck that can be used in many different types of games. For marketing purposes, there is a need to have a toy game puck that allows the logo, label, or other advertising material to be visible during the play of the sporting event or game.

SUMMARY OF THE INVENTION

A bumper toy puck is illustrated that allows the play of many different sporting events and overcomes disadvantages of traditional balls and pucks. The bumper toy is a disk-shaped toy made with a highly elastic bumper around its perimeter that causes the toy to rebound and bounce. The toy can be thrown, kicked, hit with a stick and slid depending on what game the participant chooses to play.

The bumper toy has arcuate contact surfaces and a center portion that can be used to display marketing material. The bumper toy makes contact with any playing surface on its arcuate surface for allowing the desired feel and action of the game being played regardless of the playing surface. The toy is constructed out of a material having a low coefficient of friction for sliding across many playing surfaces.

The center portion may be constructed out of a transparent material which would allow the toy to house a logo for advertisement purposes, a personalized inscription, or devices including, but not limited to a light and/or sound source for highlighting the marketing material contained within the center portion of the toy. If the center portion is opaque, the space may still be filled with any of a number of items including but not limited to, equipment to transmit or record forces, images, positions, or other such data.

The toy also contains a middle portion that, depending on the implementation, may be an annular component. The middle portion supplies the basic framework for the toy. It is to this component that the above-mentioned center portion and the below-mentioned resilient bumper are mounted. The middle portion may be constructed out of almost any material provided that it is durable enough to withstand repeated kicking and/or repeated hitting. The middle portion may also be constructed from resilient material to increase the response of the toy to the application of a force.

The most distal component of the toy is a resilient bumper mounted to the middle portion, or integrally formed with the middle portion such that the combination acts as a bumper.

These aspects and other objects, features, and advantages are described in the following Detailed Description which is to be read in conjunction with the accompanying drawings.

DETAILED DESCRIPTION

The toy game puck illustrated herein can be used on different kinds of surfaces including rough surfaces such as roadways and sidewalks, or smooth surfaces such as ice. Despite the various surfaces, the toy puck enables the sports enthusiast or participant to have a similar sensation of game play as that on a conventional playing surface. In addition, the participant, in using the toy puck obtains the feel and action similar to that of conventional game objects. The toy game puck can be used in many different types of games. For example, the toy game puck can be used in several conventional games like soccer, kickball, ice hockey, street hockey and the like. The participant can play several sporting events or games using just a single object, namely the toy game puck.

For marketing purposes, the toy game puck can contain a logo, label, or other advertising material that is visible during the play of the sporting event or game. Depending on the specific embodiment, the toy game puck can be included with visual or acoustic devices that enable the marketing material to become more visible during the play of the game.

The overall shape of the toy puck is arcuate and convex in shape. The toy may be circular, oval, rectangular, or any other geometric shape, depending on the bouncing properties required by the user. Again, the toy allows for conventional means of play (kicking, hitting with a hockey stick, etc.) and is not susceptible to slight irregularities in playing fields as standard pucks or other sports game objects. The shape of the toy includes a relatively large radius of curvature for a relatively small corresponding overall height. This feature provides the participant with an improved kicking surface. There is a reduction of area that allows the participant to place a kick below the toy due to the relatively large radius of the toy puck. This reduction in area allows the toy puck to be kicked and still remain relatively close to the playing field.

Depending on the embodiment, the density and center of gravity of the toy is similar to that of a similar sized ball. These properties also assist in keeping the kicked toy on or near the playing surface. The result is a toy that enables one to play any of a number of variants of standard games. Such games could involve the replacement of a soccer ball with the kicking toy, the replacement of weights in shuffleboard with the kicking toy, the replacement of a hockey puck or ball in ice, floor, roller or field hockey, or a variation of almost any game or sport.

Figure 1:
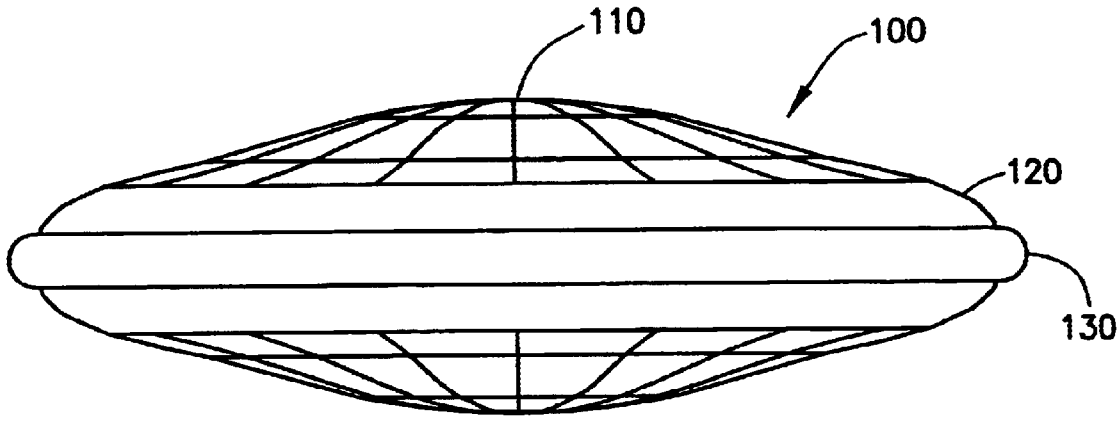
FIG. 1 is a perspective view of a bumper toy puck.

Adverting to the drawings, FIG. 1 illustrates a kicking toy 100 with a transparent center portion 110, a middle portion 120, and an bumper 130. The center portion may be constructed out of any of a number of materials that are durable and highly resilient. The center portion has high resistance to wear as well as a low coefficient of friction on most surfaces. Examples of such materials include, but is not limited to, polycarbonate (PC), polymethylmethacrylate (PMMA), polytetrafluoroethylene (PTFE), ultra high molecular weight polyethylene, clear polypropylene, and any combinations thereof.

In certain embodiments, high strength is more desirable than low friction characteristics for the middle portion 120. The middle portion 120 withstands repeated, high-force impact without deforming. Depending on the specific embodiment, middle portion 120 is attached to the center portion 110 and the bumper 130. Middle portion 120 can also be a unitary structure with center portion 110 and bumper 130. Such unitary structure can be made by a co-injection molding process, for example. The toy can be made of a material that is both strong and highly elastic. The use of a material with elastomeric properties allows for a faster and more exciting game. The material of the middle portion also may have a low coefficient of friction to assist in the prevention of the toy getting caught up on the playing surface. Depending on the implementation, the middle portion can also provide rebounding properties, as those found in bumper 130. In this configuration, the middle portion would act as an inner bumper.

The bumper 130 is not intended to absorb and dissipate impact energy in the form of heat, but to absorb impact energy and release the impact energy as kinetic energy, rebounding the kicking toy. The bumper can be made from a number of elastomeric materials such as rubber, isoprene, thermoplastic elastomers, neoprene, and the like. The bumper can be of one or many components. For example, the bumper can have an inner and an outer component. The bouncing properties of the inner and outer components can be provided by each inner and outer component individually, or in combination. Different rubbers have different damping properties. Damping or damping properties can be defined as a sound, a vibration, oscillation, motion or any form of energy that is reduced by an outside force. Damping can also be defined as dissipation of oscillatory or vibratory energy with motion or with time. Critical damping (Cc) is that value of damping that provides the most rapid response to oscillatory or vibratory energy.

The damping ratio of a material can be defined as a fraction of (Cc), generally the higher the damping ratio the better the damping properties of the material. An example of such a damping property can be seen when a small bell is rung and stopped by the placement of a hand over the bell. The sound of the bell is dampened or the vibrations reduced with the hand. Damping is inversely proportional to the bouncing capability of the material. The higher the damping property the lower the bouncing capability of the material. For example, butyl rubber has high damping physical properties and therefore has very poor bouncing capability. Silicone, on the other hand, has poor dampening properties and therefore has very good bouncing properties.

The ability of the bumper to bounce can be enhanced by using various structures or inserting media inside the bumper. For example, pressurized air could be inserted inside the bumper to enhance the bouncing properties. Various ribbed or cavities can be incorporated inside the bumper to further enhance the bouncing properties.

Figure 4:
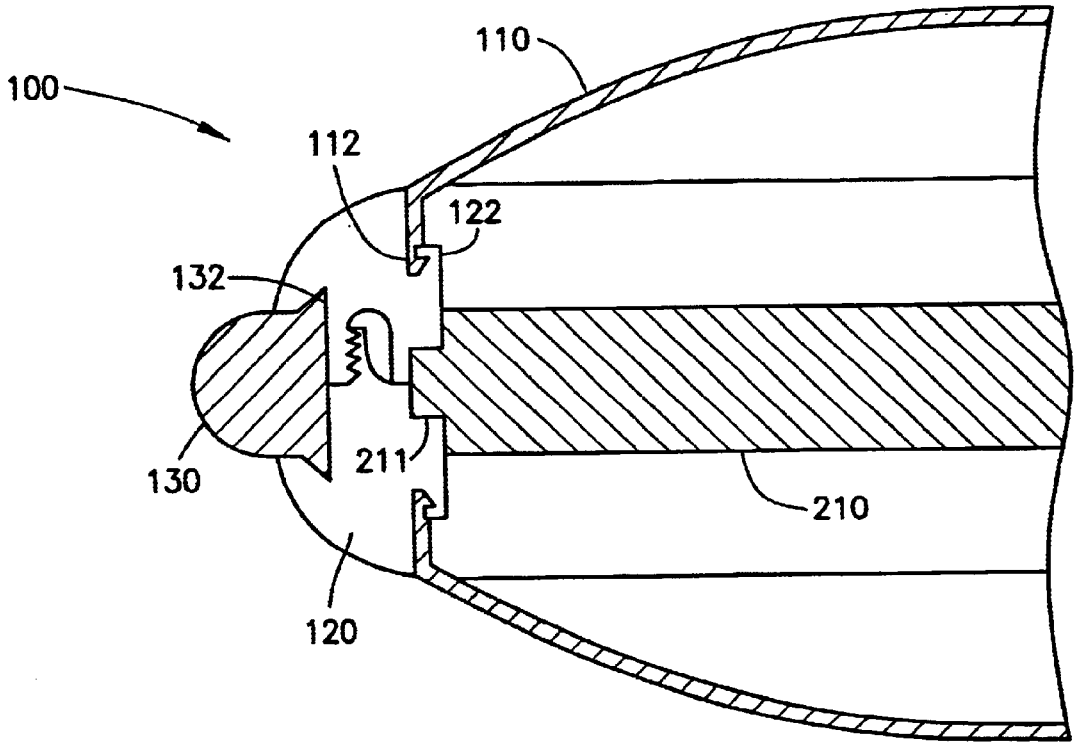
FIG. 4 is a partial cross-sectional view of the toy in FIG. 1 with a snap-in center portion and a fully elastomeric bumper.

Depending on the embodiment, springs or other resilient and elastic devices can be used in conjunction with or as a substitute for the elastomeric material of the bumper. The embodiment of the toy utilizing springs is shown in FIG. 4. Springs of various spring constants (k) can be used depending on the implementation. In addition, in other embodiments springs can be used in conjunction with other media such as pressurized air to enhance the bouncing properties of the toy.

Figure 2:
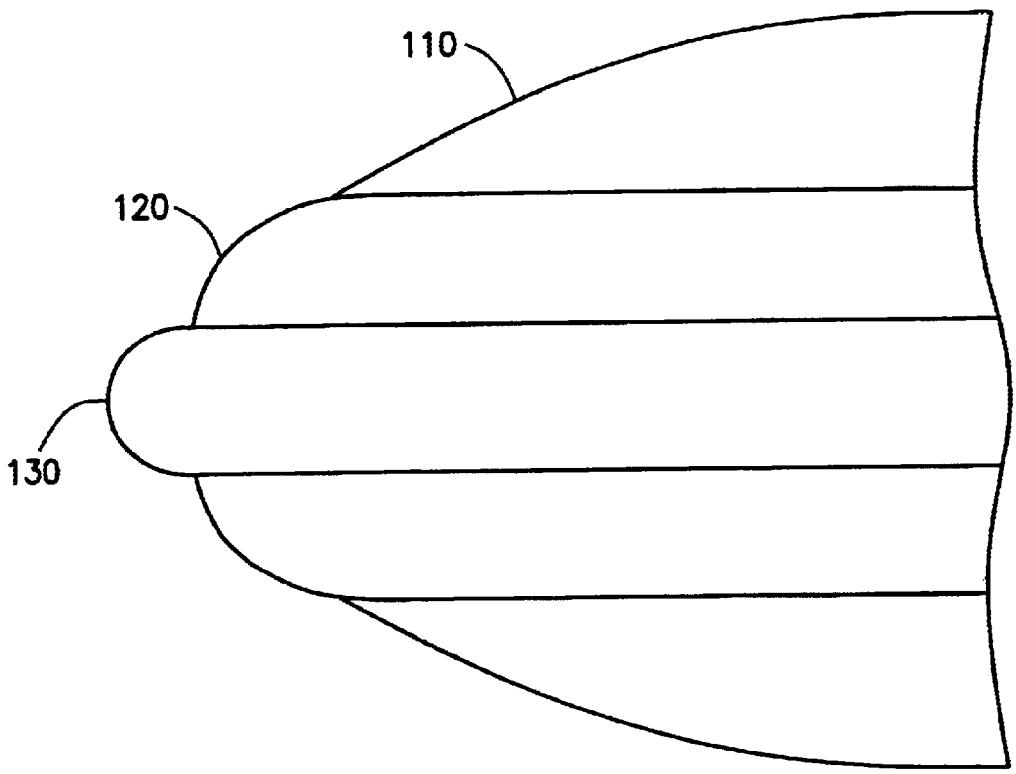
FIG. 2 is a partial side view of the toy in FIG. 1.

FIG. 2 is an enlarged side view of the toy in FIG. 1. The center portion 110 is arcuate and is adjacent to the middle portion 120. The middle portion 120 has a smaller radius than center portion 110. Again, this reduction in area allows the toy puck to be kicked and still remain relatively close to the playing field. The bumper 130 protrudes distally from the middle portion 120. This structure allows the bumper 130 to come in contact with any surface prior to the rest of the toy and allows the bouncing or rebound effect of the toy.

Figure 3:
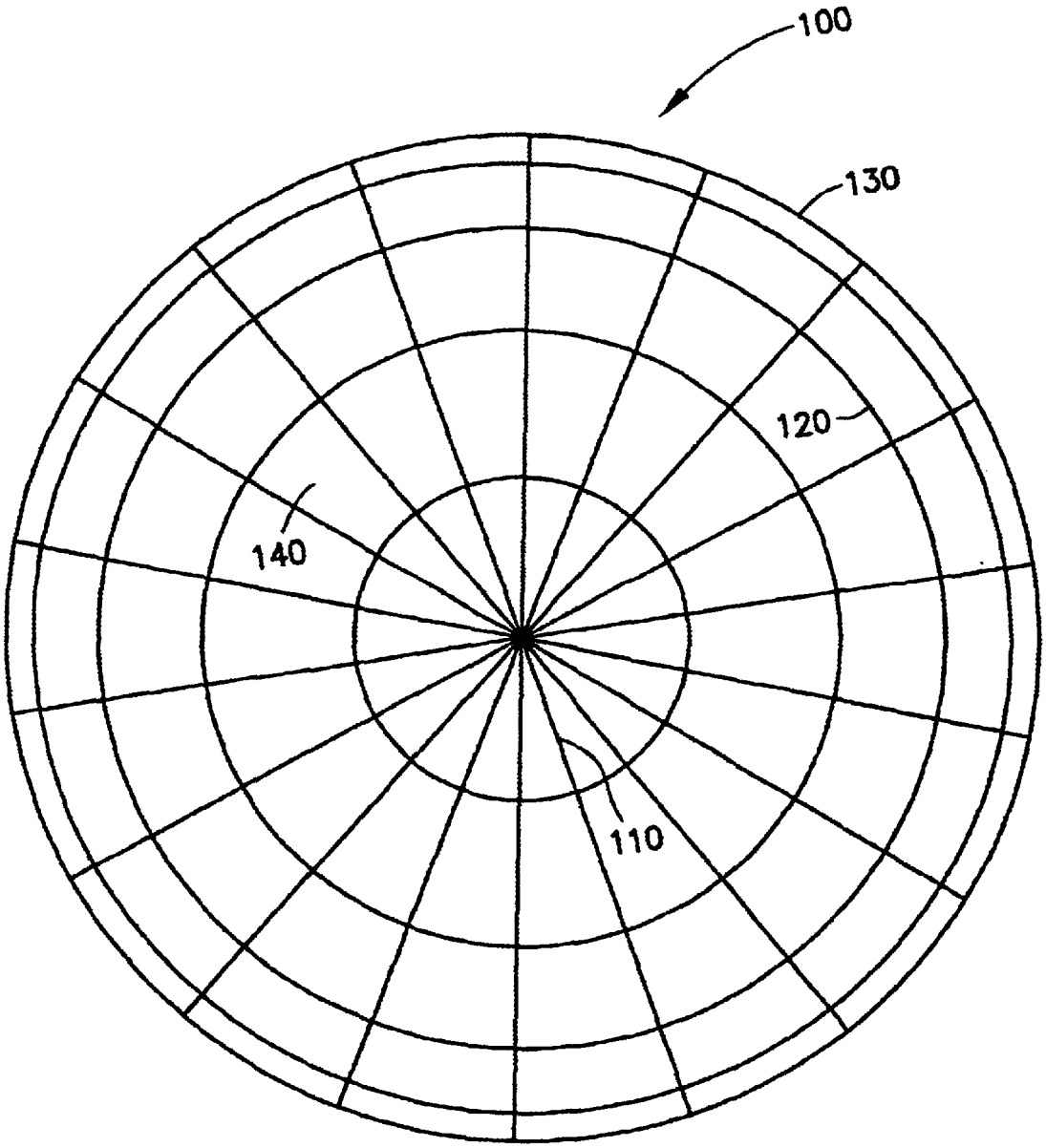
FIG. 3 is a top plan view of the toy in FIG. 1.

FIG. 3 illustrates the top view of the toy 100 as it would be seen from a player when looking down. The center portion 110, middle portion 120 and bumper 130 are shown. The toy 100 also has an area 140 that can be used to insert indicia such as logos or other such marketing materials. The area 140 may be internal or external to the toy, depending on the implementation. If the indicia is internal, the center portion is transparent or translucent so that the indicia can be viewed.

Figure 5:
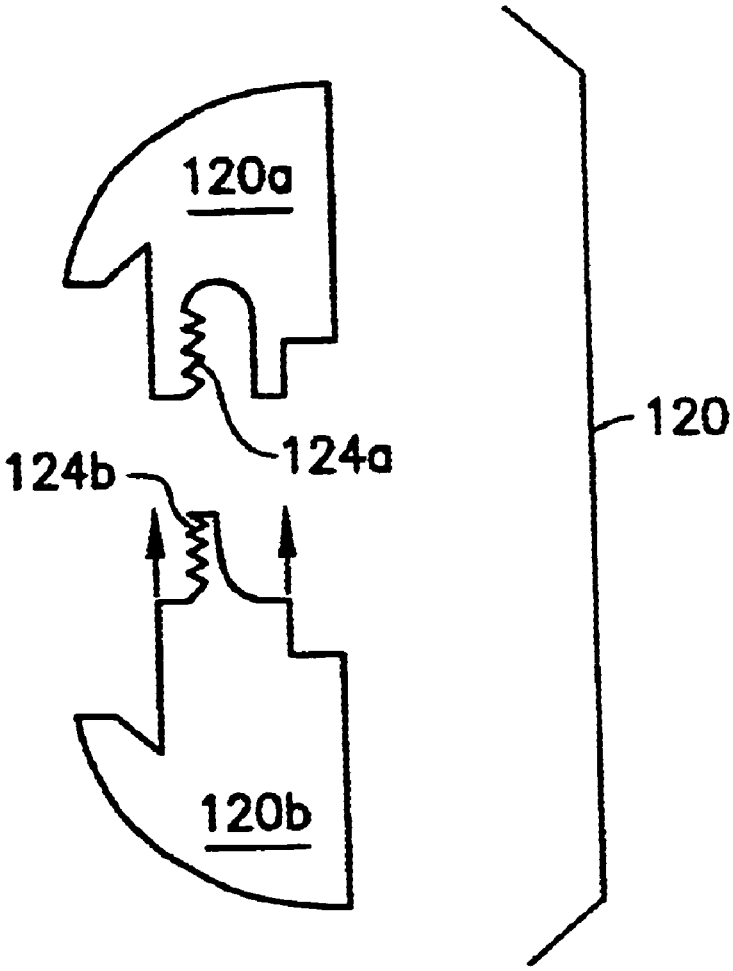
FIG. 5 is an enlarged view of the snap-in center portion shown in FIG. 4.

FIG. 4 is an enlarged partial cross-sectional view of one embodiment of the toy 100. It illustrates the center portion 110 snapping into the middle portion 120. Tab 122 of the middle portion 120 may or may not bend slightly when inserting the center portion 110 by snap fit arm 112. Two sections, 120*a* and 120*b* as shown in FIG. 5, of the middle portion 120 could snap together or be made as a unitary structure such as a one piece insert, depending on the implementation. If the middle portion is made of more than one piece as shown in FIG. 5, posts and sockets or other fixing means such as an adhesive, screws, pins, ultrasonic welding, solvent bonding, heat welding and the like made be used to attach the sections of the middle portion together.

Indicia 210 as shown in FIG. 4 can also be attached to the middle portion also by various means. Shown in FIG. 4 is one embodiment were a tab 211 of insert 210 is attached to middle portion 122. In addition, the indicia and middle portion may or may not be made as a unitary structure. For example, the indicia or marketing material can be insert molded with the center portion to form one piece.

The bumper 130 shown in FIG. 4 may or may not be an insert piece depending on the embodiment. In the embodiment shown, bumper 130 is prevented from falling off of the middle portion 120 by wings 132. Wings 132 are intended for this purpose of structural integrity, but a variety of methods for attaching the middle portion 120 with the bumper 130 may be used, including mechanical fasteners or adhesives or other methods previously described.

FIG. 5 demonstrates the use of snap teeth 124*a* and 124*b* used to connect two pieces of middle section 120*a* and 120*b* together. The advantage of having more than one piece for the middle section is that the insert 210 shown in FIG. 4 can easily be removed or changed based on the desired marketing theme.

Figure 6:
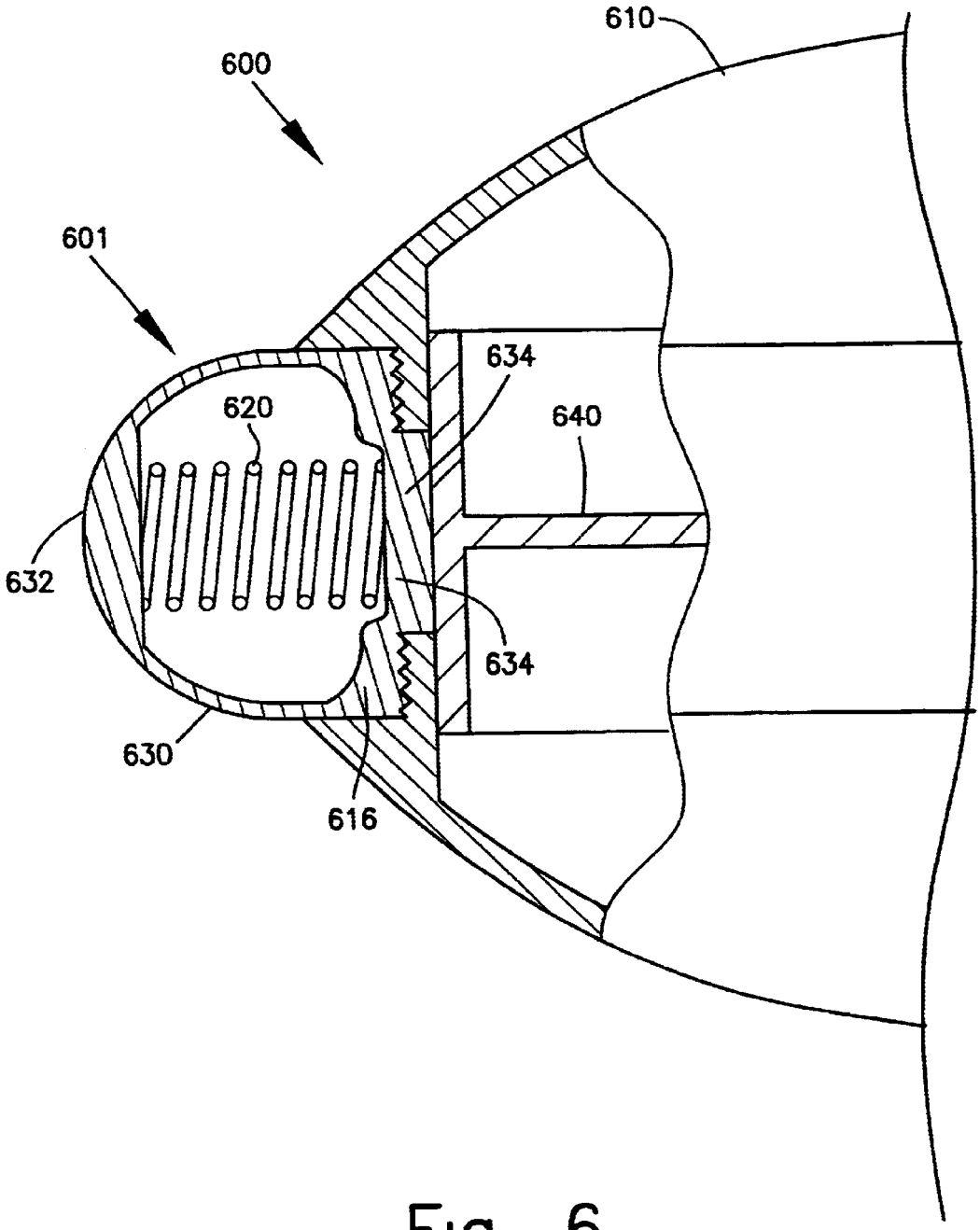
FIG. 6 is the toy of FIG. 1 utilizing springs in addition to an elastomer for the outer bumper portion.

FIG. 6 illustrates an enlarged partial cross-sectional side view of toy 600 wherein the elastomeric bumper 130 has been replaced by a composite spring-loaded bumper 601. The toy 600 has a transparent or translucent center portion 610 to view indicia 640. The bumper 601 comprises a flexible, yet durable rubber cover 630, which is either mounted on the middle portion 634, or made as one piece with the middle portion. The flexible cover 630 has a reinforced surface 632 where a spring 620 or plurality of springs interfaces with the cover 630. A base 616 of the bumper 601 is formed to interface with the middle portion 634 to provide additional structural integrity to the bumper and bonding to the middle portion.

Spring 620 shown in FIG. 6 for this embodiment of the toy is placed radially from the center, such that when being hit, the spring or springs of the kicking toy in line with the application of force first compresses, then expands, propelling the kicking toy forward. Once the toy strikes an obstacle, a portion of its kinetic energy is stored by the spring(s) and then released, again helping propel the kicking toy. Additionally, the use of springs individually pocketed in sheathes might be desirable to help contain the coils of the springs and help prevent kinking or tangling and resultant ineffectiveness.

Figure 7:
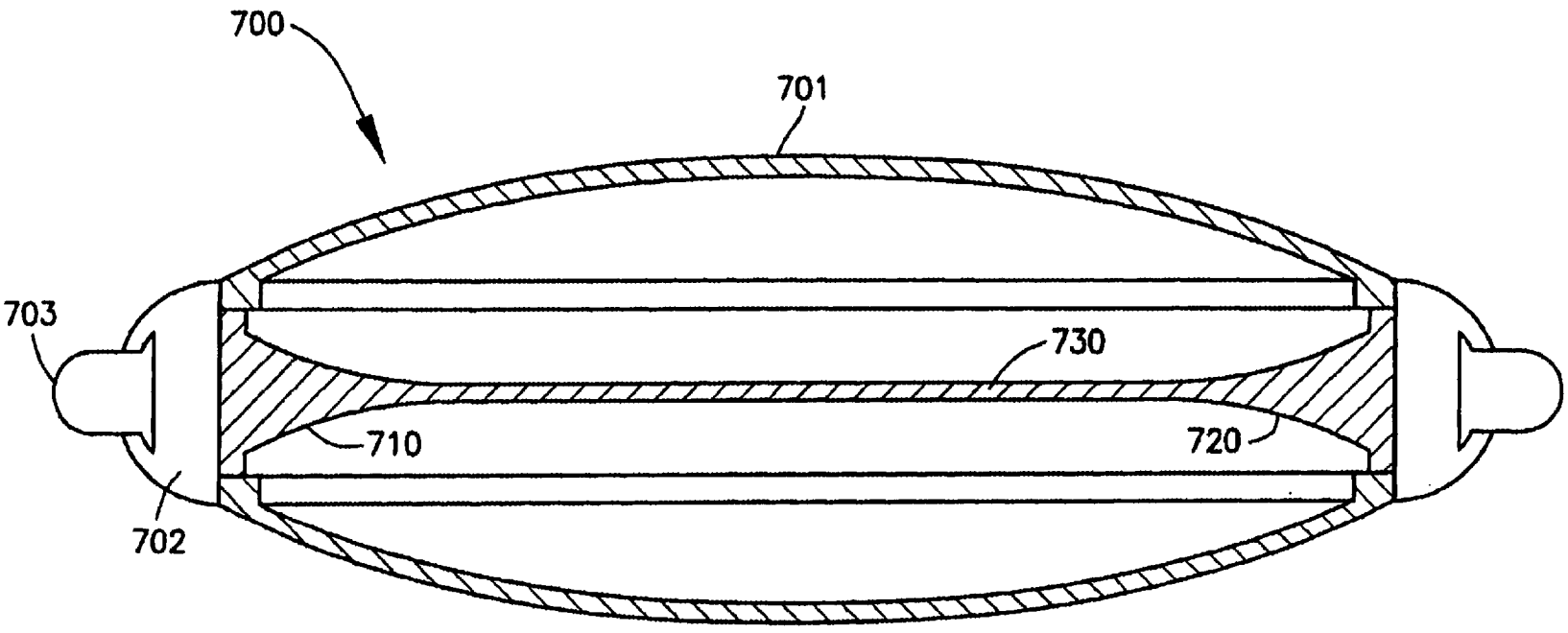
FIG. 7 is a partial cross-sectional view of the toy in FIG. 1 showing support for indicia.

Turning to FIG. 7, shown is a partial cross-sectional side view of toy 700. Toy 700 has a center section 701, a middle section 702, and a bumper 703. The center and middle sections as well as the bumper may be similarly structured as toy 100 previously described. Also shown in FIG. 7 is indicia 730. Indicia 730 may be any type of marketing material. For example, designs, logos, trademarks, phrases, and the like. Indicia 730 is supported by two support members 710 and 720. Supports 710 and 720 can be a variety of different support structures. For example, supports 710 and 720 can include snap fits, molded inserts, fasteners, welded support arms, and any other type of supporting structure. The purpose of the support members is to support the indicia inside the center portion such that the indicia does not come into contact with the inside walls of the center portion. This feature may be desirable if a three dimensional effect of the indicia is required.

Figure 8:
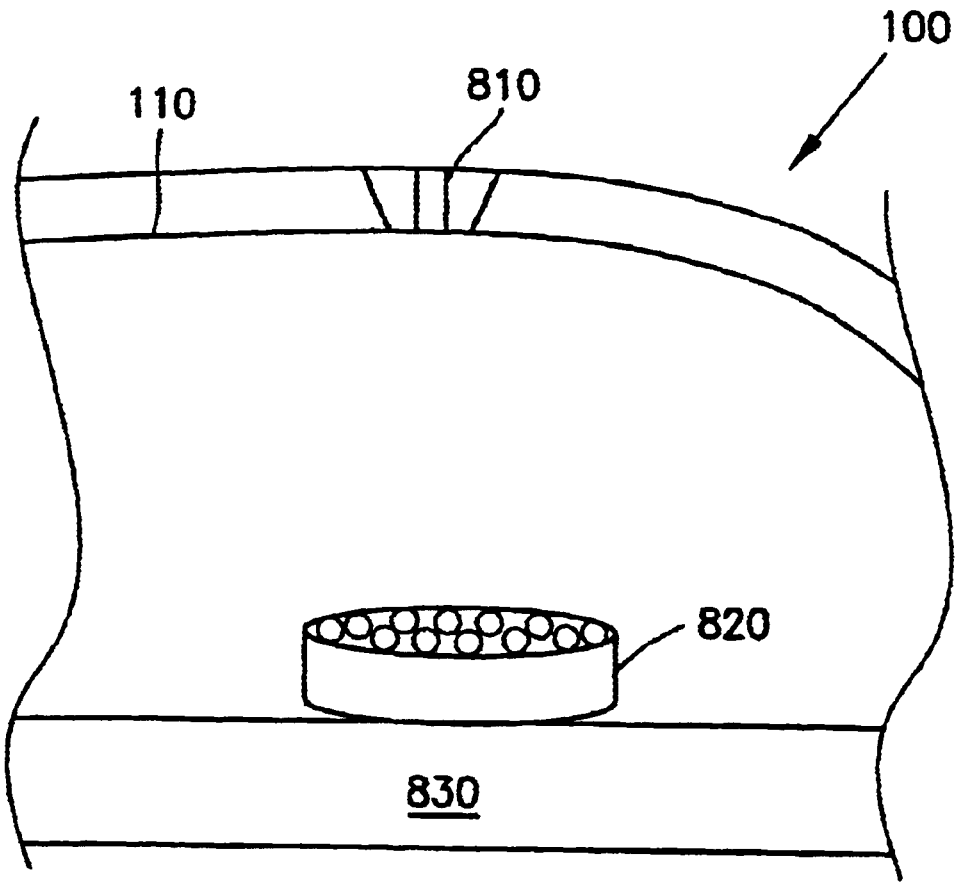
FIG. 8 is a partial side view of the toy in FIG. 1 having visual and acoustic conductors in the center portion.

FIG. 8 illustrates an enlarged partial cross-sectional side view of one embodiment of the toy 100. Shown in this Figure is a lighting or visual device 810 and an acoustic device 820. Lighting device 810 may be incorporated into the center portion 110 as shown in FIG. 8 or inside the center portion depending on the lighting effect desired. The lighting device 810 may be any of a number of light emitters including, for example, motion activated bulbs, battery powered bulbs, light-emitting diodes, electroluminescent elements and speed activated light emitters. The lighting device 810 is made compact enough and positioned in the toy so as not to disturb the play of the game but to highlight the marketing material 830 contained within the toy. Alternatively, the lighting device 810 may be placed so as to transmit light out of the toy in addition to or instead of illuminating the marketing material 830. Similarly, the acoustic device 820 is positioned to highlight the marketing material and/or be a substitute for the marketing material. For example, the acoustic device can contain a recorded jingle of a company being advertised. The acoustic device can be programmed to play at certain times like when the toy is in motion or when the toy reaches a particular speed when kicked or hit.

Figure 9:
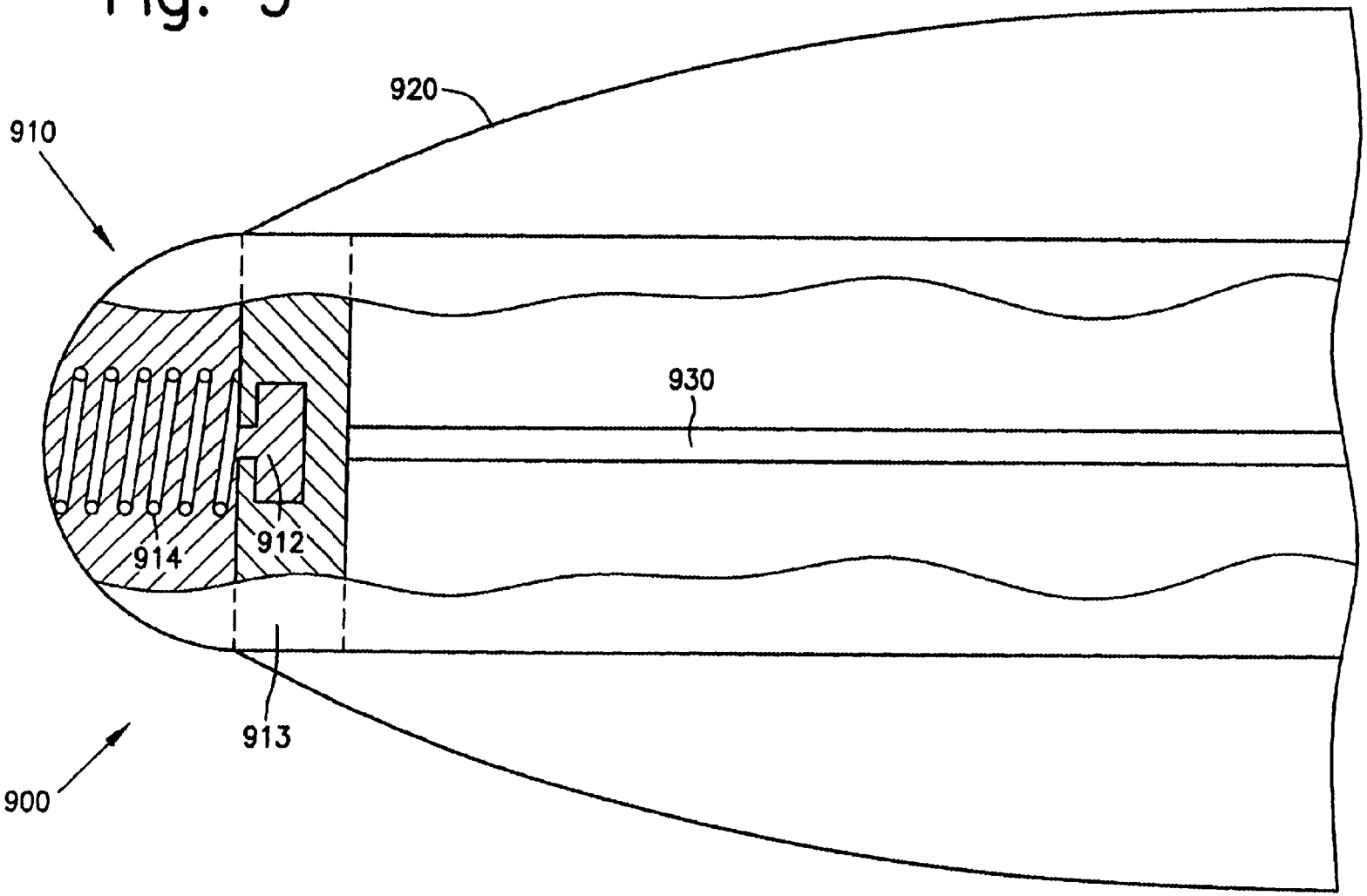
FIG. 9 is a partial cross sectional-view of the toy in FIG. 1 with a spring activated bumper.

FIG. 9 is an enlarged partial cross-sectional view of a toy 900. Toy 900 had a center portion 920 and a bumper 910. Depending on the embodiment, bumper 910 can have a spring element 914 or may just be made of an elastomeric material as previously described. The toy 900 also has marketing material of indicia 930 positioned inside the toy. However, as previously described, indicia 930 can be outside of center portion 920. The bumper 910 is attached in this embodiment by a snap fit 912 to wall 913 of center portion 920. Again, there are various methods of attaching bumper 910 to center portion 920 as previously described. The center portion 920 is convex shaped as the center portion of other embodiments of the toy previously described. This shape is to allow the toy to have less surface contact with the playing field and assist in the toy's sliding feature by providing less area on the toy for hang ups on the sliding surface while the toy in moving.

Figure 10:
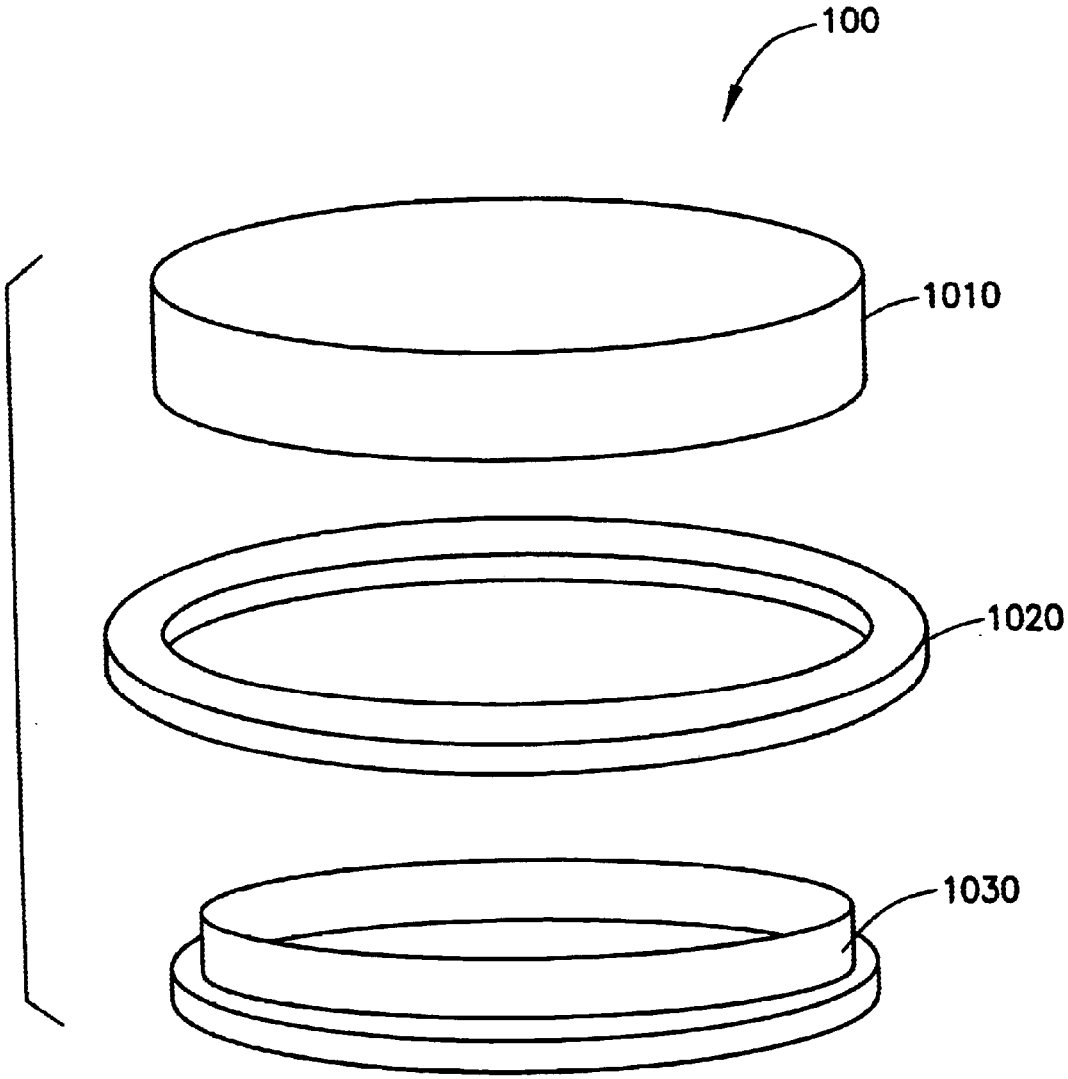
FIG. 10 is an exploded view of the toy in FIG. 1.

FIG. 10 is an exploded view of toy 100. In this figure the toy is made of three components instead of two as previously shown in FIG. 9. Toy 100 in this embodiment has a center portion 1010, a bumper 1020 and a middle portion 1030. The three components can be individually bonded together as previously described. The use of individual components in this embodiments allows the flexibility to replace the center portion with several different types of center portions containing different types of marketing material. This feature would allow inventories of the bumper 1020 and middle portion 1030 components to be used with other types of toy 100 containing different marketing materials.

Figure 11:
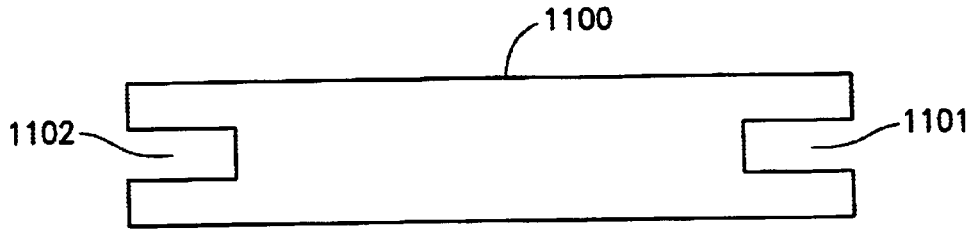
FIG. 11 is one embodiment of the middle portion in FIG. 1.
Figure 12:
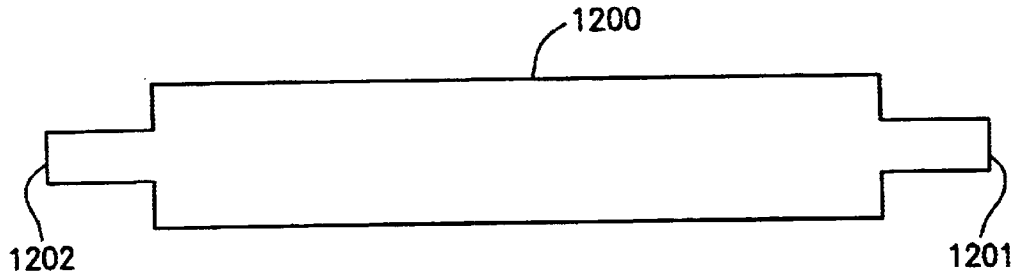
FIG. 12 is another embodiment of the middle portion in FIG. 1.

Shown in FIGS. 11 and 12 are two different types of mounting the marketing or indicia contained on or in the center portion. In FIG. 11 indicia 1100 is mounted using cavities 1101 and 1102. This cavities are mounted to matching sections on the center portion 1010 (not shown). Similarly, in FIG. 12, indicia 1200 is mounted on center portion 1010 by prongs 1201 and 1202. The prongs insert into matching cavities (not shown) in center portion 1010.

Figure 13:
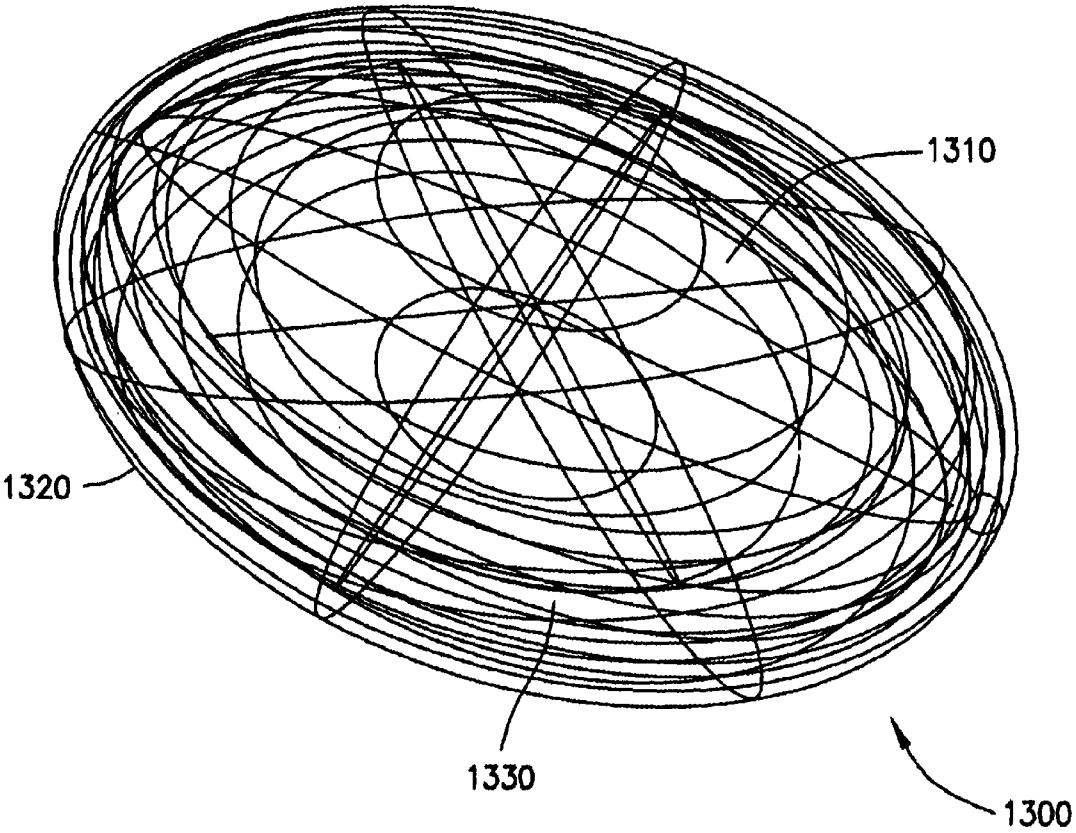
FIG. 13 is a perspective view of the toy in FIG. 1 illustrating another shape of the toy.

FIG. 13 illustrates an oval-shaped toy 1300 when viewed from the top. The toy can be any shape, depending on the bouncing properties required by the end user. For example, the toy may be any of several different shapes when viewed from the top, including, but not limited to rectangular, cubic, cone-shaped or any other polygonal shape. A center portion for the housing of indicia 1310, an outer bumper 1320 and a middle portion 1330 are shown.

Figure 14:
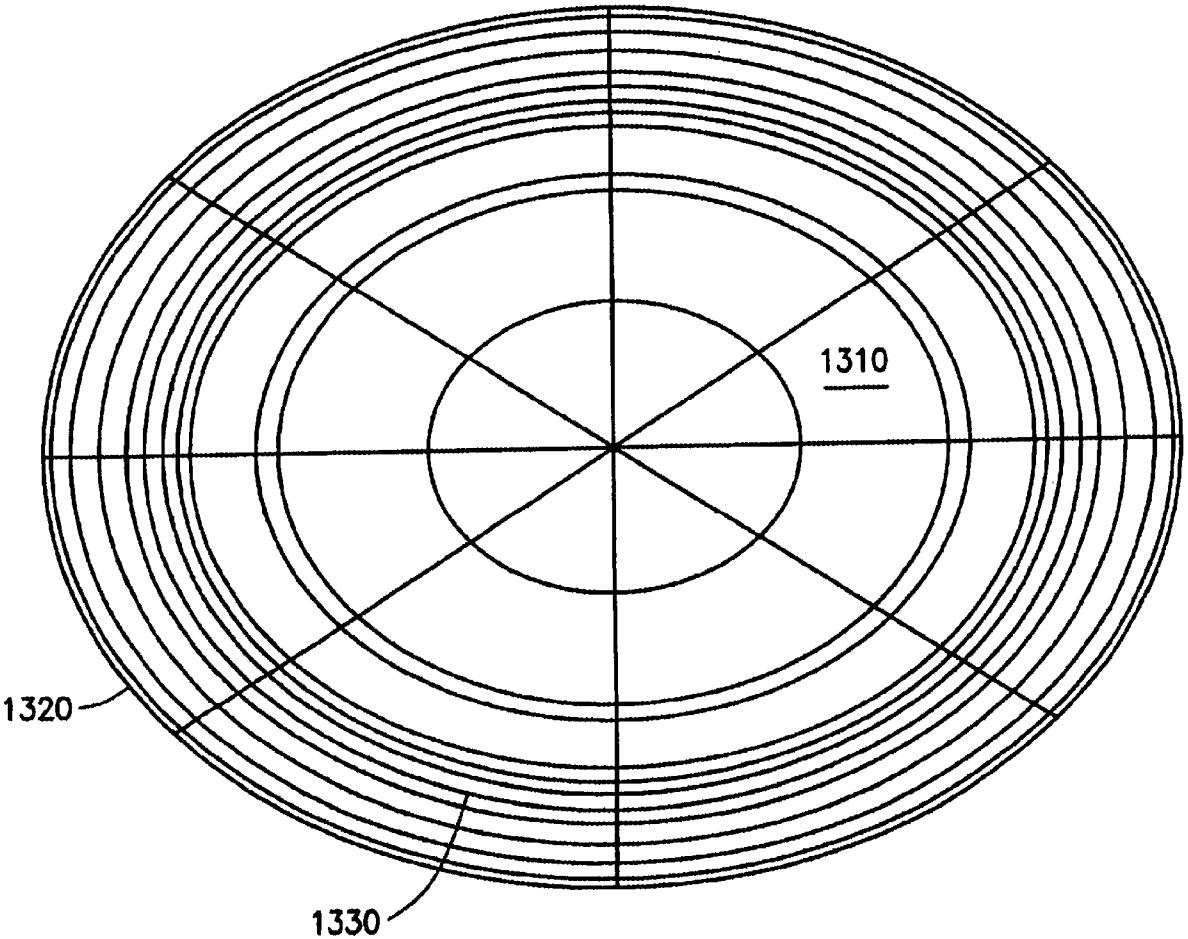
FIG. 14 is a top view of the toy in FIG. 13.

FIG. 14 is a top view of the oval-shaped toy 1300. Similarly to FIG. 13, a center portion for the housing of indicia 1310, bumper 1320 and middle portion 1330 are shown.

Figure 15:
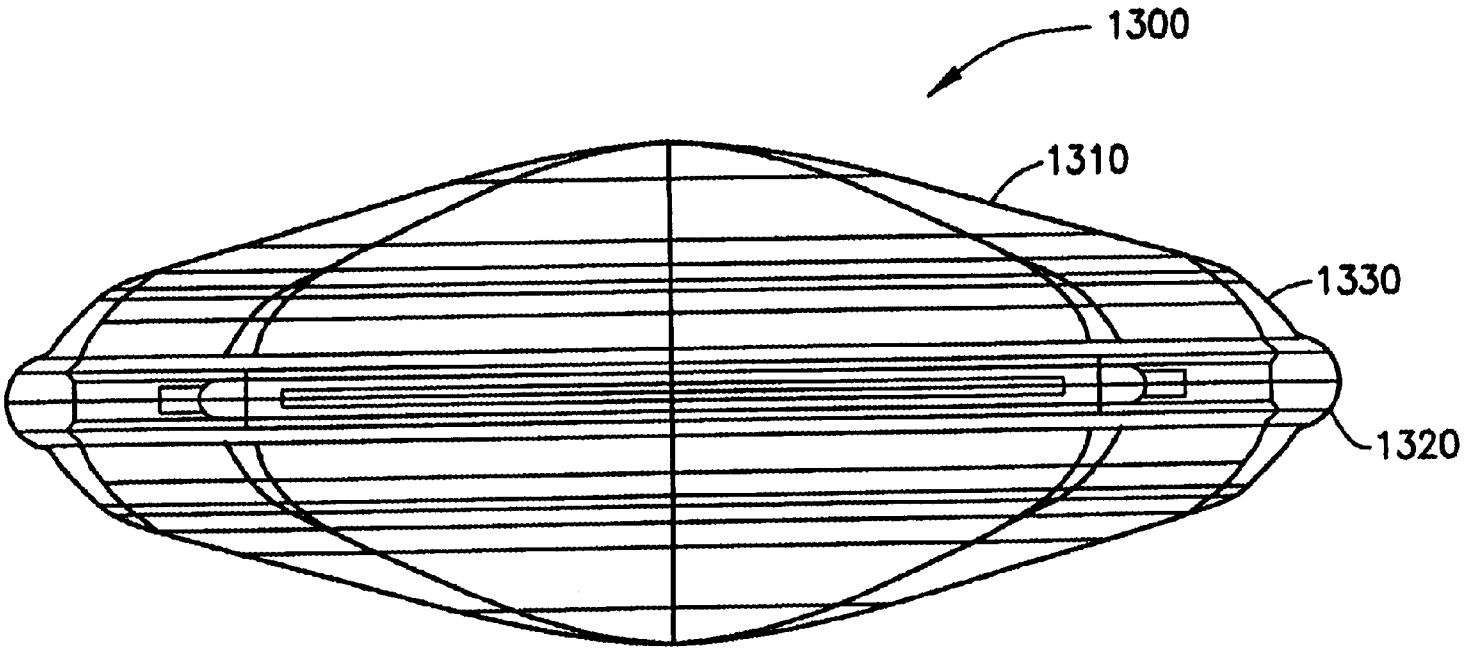
FIG. 15 is a front view of the toy in FIG. 13.

FIG. 15 is a front view of the oval-shaped toy 1300. A center portion 1310, bumper 1320 and middle portion 1330 are shown. A difference in width can be seen between this side view and the front view illustrated in FIG. 15.

Figure 16:
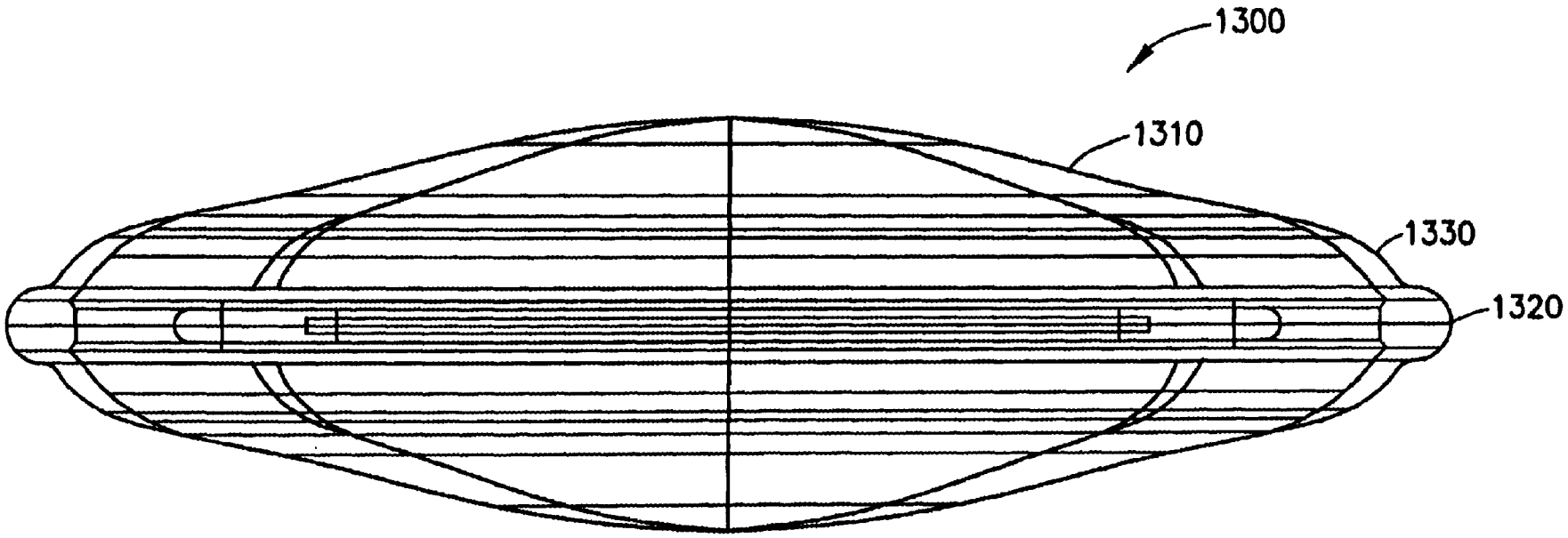
FIG. 16 is a side view of the toy in FIG. 13.

FIG. 16 is a side view of the oval-shaped toy 1300. A center portion 1310, bumper 1320 and middle portion 1330 are shown. A difference in width can be seen between this side view and the front view illustrated in FIG. 15.

Although the invention has been described in detail in the foregoing embodiments, it is to be understood that the descriptions have been provided for purposes of illustration only and that other variations both in form and detail can be made thereupon by those skilled in the art without departing from the spirit and scope of the invention, which is defined solely by the appended claims.

Furthermore, since numerous modifications and variations will readily occur to those skilled in the art, it is not desired that the present invention be limited to the exact construction and operation illustrated. Accordingly, all suitable modifications and equivalents which may be resorted to are intended to fall within the scope of the claims.

It should be understood that the above description is only representative of illustrative examples of embodiments and implementations. For the reader's convenience, the above description has focused on a representative sample of all possible embodiments, a sample that teaches the principles of the invention. Other embodiments may result from a different combination of portions of different embodiments. The description has not attempted to exhaustively enumerate all possible variations. For example, the outer bumper may be incorporated with other resilient and elastic device to increase the bouncing properties of the toy or the bumper may be used alone. Alternatively, the bumper may incorporated into the middle section. Similarly, the center section may be incorporated into the middle and bumper sections. It is recognized that doing so may or may not allow for the deletion or addition of one or more of the functions described herein given as examples of the operation and configuration of the toy.

Alternate embodiments may not have been presented for a specific portion of the invention, and may result from a different combination of described portions, or that other undescribed alternate embodiments may be available for a portion, is not to be considered a disclaimer of those alternate embodiments. It is appreciated that many of those undescribed embodiments are within the literal scope of the following claims, and others are equivalent.

What is claimed is:

1. A bumper toy comprising:

a convex center portion for housing indicia;

a middle portion disposed around the center portion; and a bumper means disposed about the middle portion for propelling the toy when the toy is forcibly compressed or expanded.

2. The bumper toy of claim 1, wherein the indicia is supported by support means attached to the middle portion.

3. The bumper toy of claim 1, wherein the center portion further includes an acoustic device.

4. The bumper toy of claim 1, wherein the center portion further includes a lighting device for illuminating the indicia.

5. The bumper toy of claim 1, wherein the middle portion forms a larger radius than the center portion for providing less kicking surface area.

6. The bumper toy of claim 1, wherein the middle portion is made of a material having a low coefficient of friction.

7. The bumper toy of claim 1, wherein the bumper means is symmetrically attached to the middle portion.

8. The bumper toy of claim 1, wherein the center portion forms opposing arcuate surfaces such that at least one of the arcuate surfaces makes contact with a sliding surface for allowing the bumper toy to slide thereon.

9. The bumper toy of claim 1, wherein the center portions, middle portion and bumper means are a unitary structure.

10. The bumper toy of claim 1, wherein the bumper means is at least one of an elastomer, a metallic substance, spring, pressurized air, or any combination thereof.

11. The bumper toy of claim 1, wherein the center portion is transparent or translucent.

12. The bumper toy of claim 1, further including at least one of a piece of equipment disposed within the center portion of the bumper toy, to transmit or record forces, images, or positions.

13. The bumper toy of claim 1, further including a holding means for securing the indicia to the center portion.

14. The bumper toy of claim 1, wherein the shape of the toy is circular, oval, rectangular, or any other geometric shape, depending on the bouncing properties required.

15. A bumper toy comprising:

a center portion that is convex and circularly shaped for allowing viewing of indicia held therein;

an inner bumper circumferentially disposed about the center portion; and an outer bumper attached to the inner bumper such that the outer bumper is not in communication with the center portion, and the outer bumper and the inner bumper allow the toy to bounce.

16. The bumper toy of claim 15, wherein the inner bumper has a surface radius larger than the outer bumper for increasing the resilient properties of the toy.

17. The bumper toy of claim 15, wherein the center portion is made of a material having a low coefficient of friction.

18. The bumper toy of claim 17, wherein the material is polycarbonate, polymethylmethacrylate, polytetrafluoroethylene, ultra-high molecular weight polyethylene, clear polypropylene, polyvinyl chloride, silicone, paper, glass, ceramic, nylon, acetal, or any combinations thereof.

19. The bumper toy of claim 15, wherein the outer bumper has lower damping properties than the inner bumper.

20. The bumper toy of claim 15, wherein the outer bumper protrudes further distally from the center portion than the inner bumper protrudes distally from the center portion.

* * * * *